US011139598B1

(12) United States Patent
Casher et al.

(10) Patent No.: US 11,139,598 B1
(45) Date of Patent: Oct. 5, 2021

(54) CARD EDGE CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Patrick R. Casher, North Aurora, IL (US); Yuan-Yuan Dong, Kunshan (CN); Xiao-Hu Yin, Huaian (CN); Wen-Jun Tang, Kunshan (CN); Xue-Wu Bu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/878,578

(22) Filed: May 19, 2020

(51) Int. Cl.
*H01R 4/66* (2006.01)
*H01R 12/73* (2011.01)
*H01R 12/71* (2011.01)

(52) U.S. Cl.
CPC ..... *H01R 12/737* (2013.01); *H01R 12/712* (2013.01)

(58) Field of Classification Search
CPC . H01R 23/688; H01R 23/7068; H01R 9/0757
USPC ..... 439/108, 60, 637, 636, 405
See application file for complete search history.

(56) References Cited

U.S. PATENT DOCUMENTS 3,414,871 A * 12/1968 Tuchel ..... H01R 13/428 439/748
5,711,690 A * 1/1998 Thrush ..... H01R 43/16 29/874
6,095,321 A * 8/2000 Striegl ..... B65G 15/34 198/847
6,099,328 A * 8/2000 Nelson ..... H01R 12/721 439/101

FOREIGN PATENT DOCUMENTS

CN 110429405 A 11/2019

* cited by examiner

*Primary Examiner* — Phuong Chi Thi Nguyen
(74) *Attorney, Agent, or Firm* — Ming Chieh Chang; Wei Te Chung

(57) ABSTRACT

A card edge connector includes a longitudinal insulative housing, two rows of terminals and an insulative block fixed therein. The insulative housing includes two side walls and a card slot between the side walls and opening upward, the side walls defines grooves for receiving terminals and opening downward. Each terminal includes a retaining portion fixed in the groove, each row of the terminals including a plurality of signal terminals and a plurality of grounding terminals. Each signal groove loaded with the signal terminal is filled with the insulative block, the block fitly abuts against the retaining portion of the signal terminal.

16 Claims, 12 Drawing Sheets

CARD EDGE CONNECTOR

BACKGROUND OF THE DISCLOSURE

1. Field of the Disclosure

The present disclosure relates to a card edge connector, and more particularly to a card edge connector with structures for reducing resonances for high-frequency performance.

2. Description of Related Arts

Chinese Patent Publication No. CN110429405A discloses a card edge connector including a longitudinal insulative housing, two rows of terminals and a pair of conductive plastic blocks retained therein, the insulative housing has two side walls and defines a card slot between the side walls. The two rows of terminals are fixed on the side walls, each row of terminals includes a plurality of signal terminals and a plurality of grounding terminals. The insulative housing defines a pair of longitudinal slots penetrating through the bottom surface of the card edge connector. The conductive plastic blocks are fixed into the longitudinal slots from the bottom surface. The blocks press against the grounding terminals to establish an electrical connection, but do not contact the signal terminals.

An improved arrangement is desired to reduce the resonances producing by the signal terminals and enhance high frequency performance of the card edge connector.

SUMMARY OF THE DISCLOSURE

An object of the invention is to provide a card edge connector. The card edge connector comprises a longitudinal insulative housing comprising two side walls and a card slot between the side walls and opening upward, the side walls defines a plurality of grooves, and each groove opens downward and defines a fixing groove and a receiving groove; a row of terminals are arranged on the each side wall and comprises signal terminals and grounding terminals, each terminal includes a retaining portion fixed in the fixing groove, an elastic portion passing through the receiving groove and exposed to the card slot, and a soldering portion extending out of the insulative housing; a plurality of insulative blocks; the receiving grooves loaded with the signal terminals are filled with the insulative blocks, and insulative blocks abut against the retaining portions of the signal terminals, the retaining portions of the grounding terminals are exposed to an air without any insulative blocks.

An object of the invention is to provide a card edge connector. The insulative block is installed in the signal groove loaded with the signal terminal and isolates signal terminals from air, so as to reduce resonances producing by the signal terminals, and improve a high-frequency performance of the card edge connector.

Other objects, advantages and novel features of the disclosure will become more apparent from the following detailed description when taken in conjunction with the accompanying drawings.

DETAILED DESCRIPTION OF THE PREFERRED EMBODIMENT

Referring to FIGS. 1-7 illustrating a card edge connector 100 of a first embodiment of this present invention, the card edge connector 100 includes a longitudinal insulative housing 10, and two rows of terminals 20 and insulative blocks 30 fixed in the housing. The card edge connector 100 is used to receive a card or a card module (not shown) to realize signal transmission between the card and a mother board.

Figure 4:
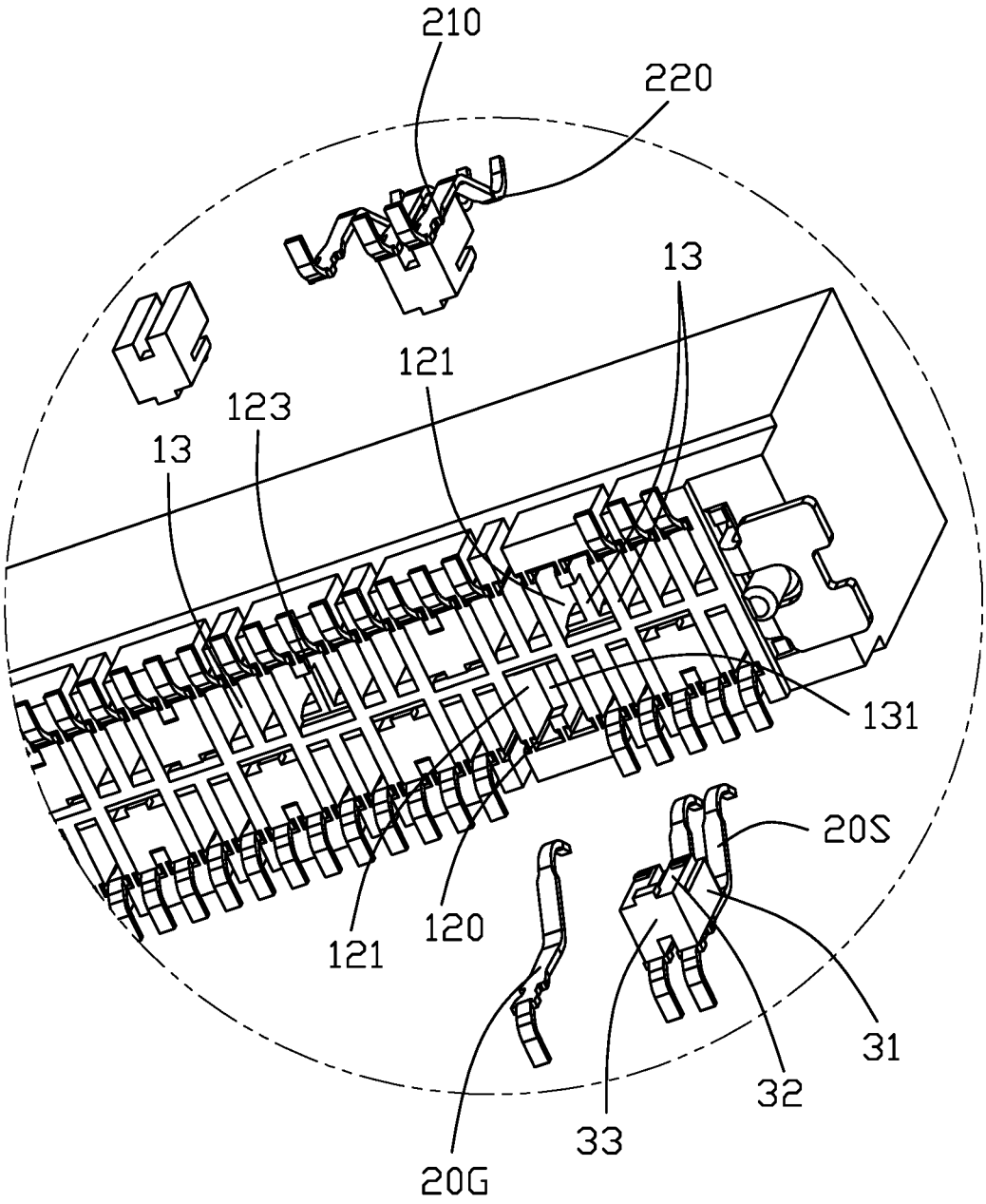
FIG. 4 is a partial view of the card edge connector of FIG. 3 in circle.

The insulative housing 10 includes two long or side walls 11 and defines a card slot 101 between the two side walls 11, the card slot 101 extends in a longitudinal direction of the connector, and opens upward. The side wall 11 defines grooves 12 opening downward and between every adjacent partition walls 13 as best shown in FIG. 4. The terminals 20 are received in the grooves 12 one by one. Each of the grooves 12 defines a fixing groove 120 and a receiving groove 121 as shown in FIGS. 4-6.

Figure 1:
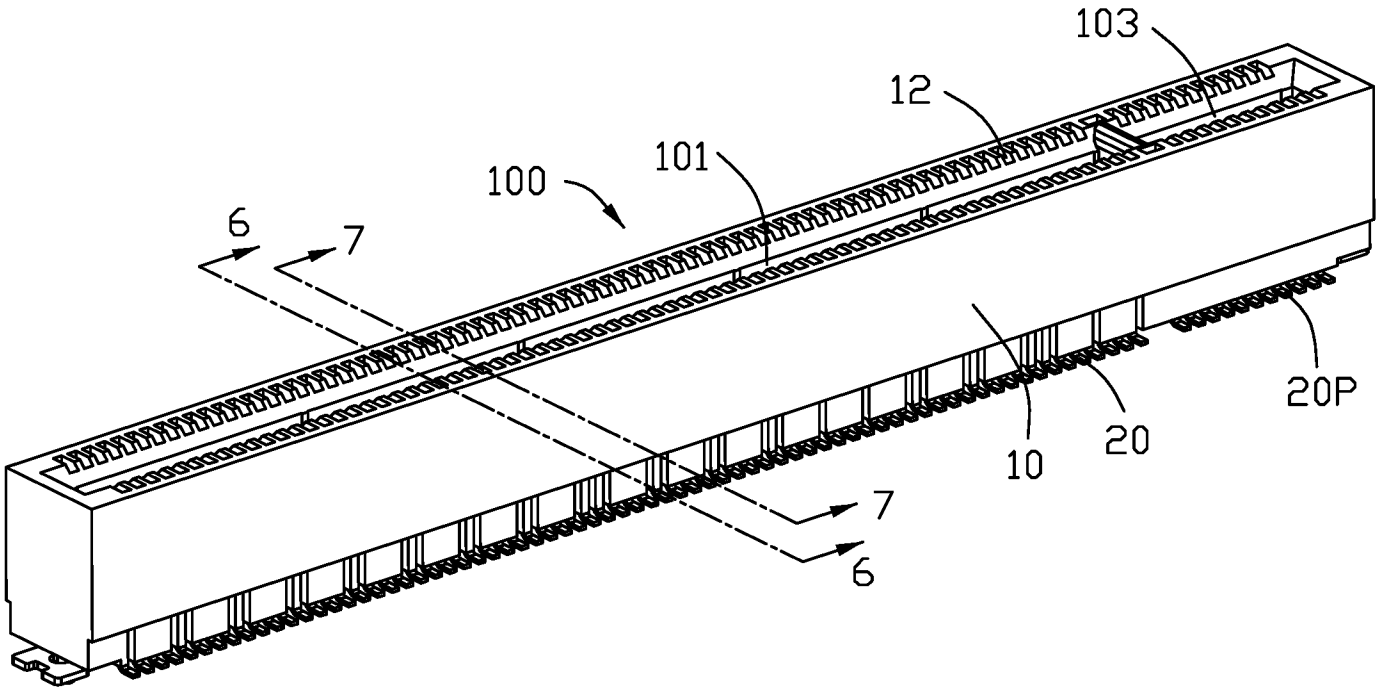
FIG. 1 is a top perspective view of a card edge connector according to a first embodiment of the invention.
Figure 2:
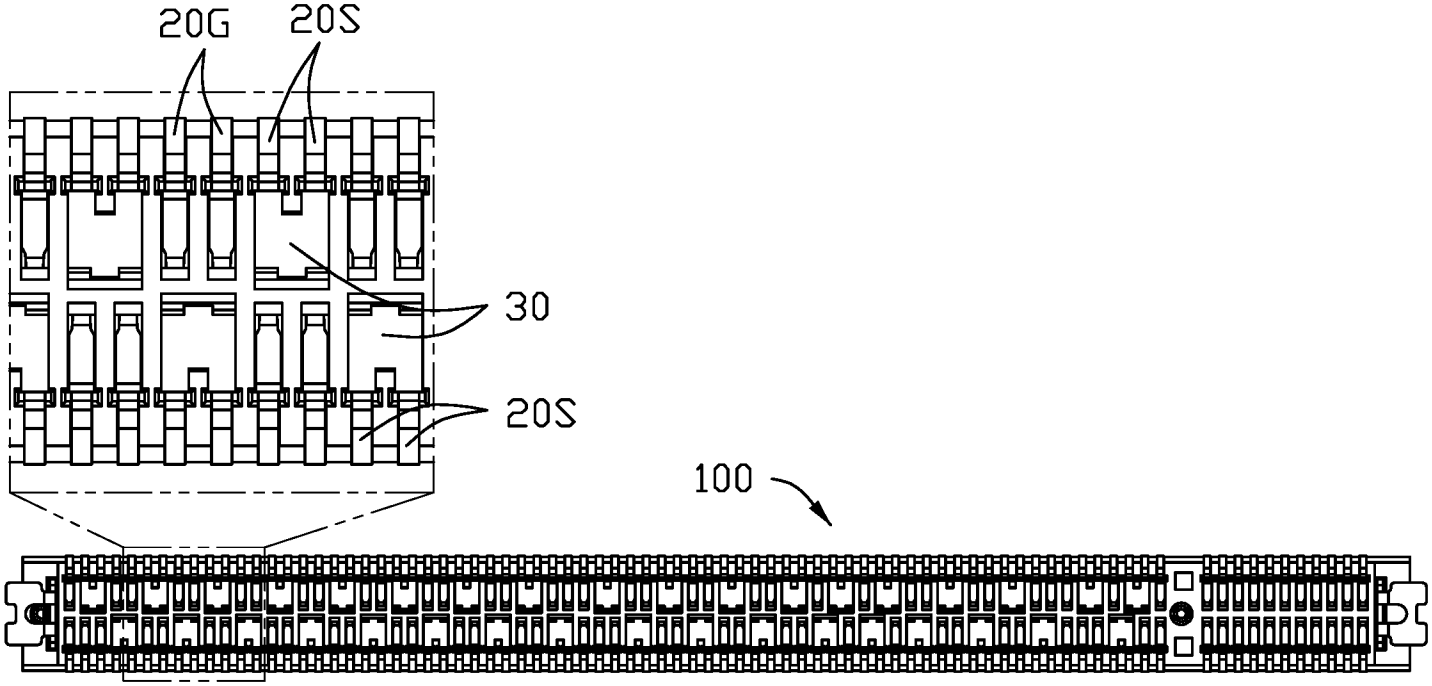
FIG. 2 is a bottom view and a partially enlarged view of the card edge connector of FIG. 1.
Figure 3:
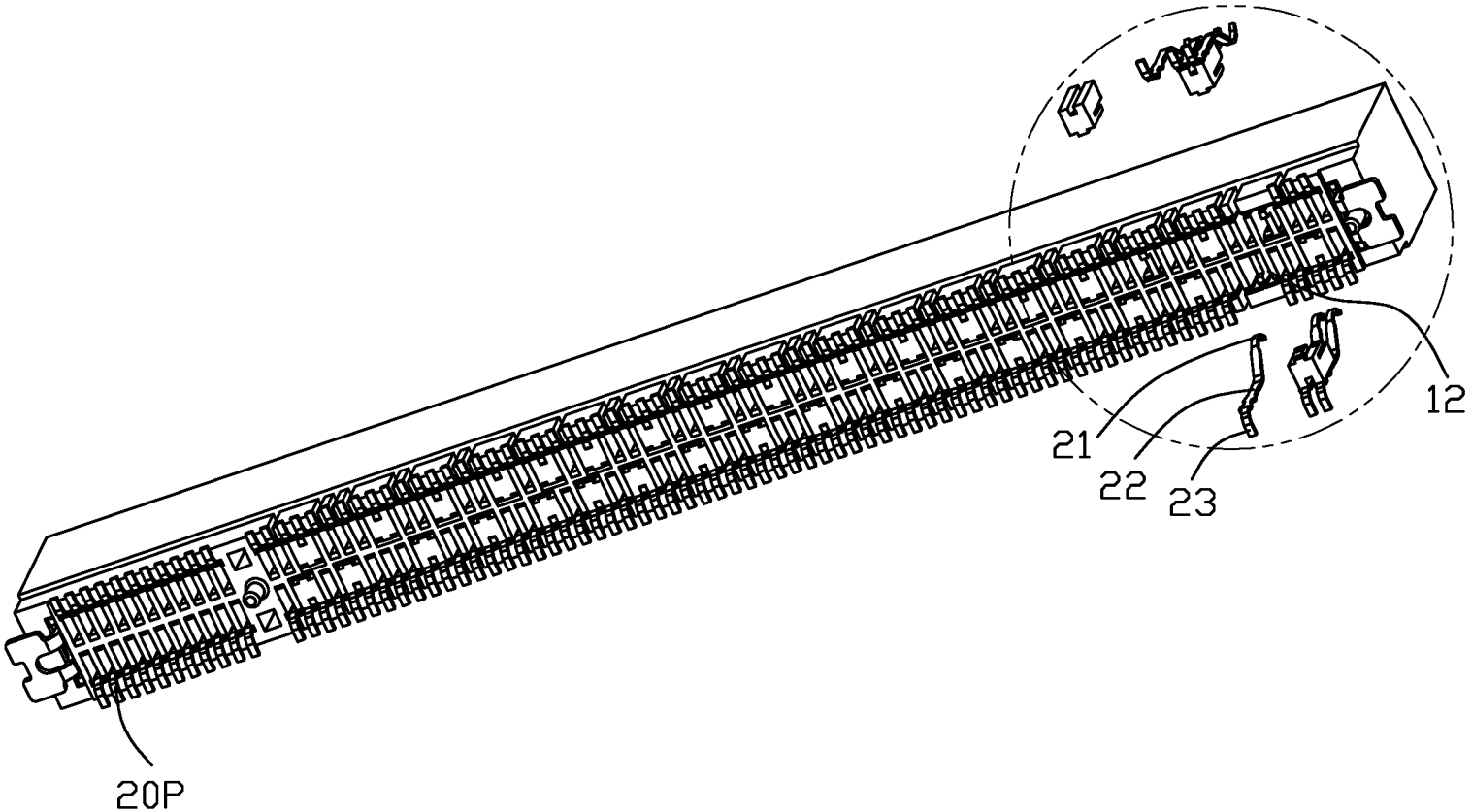
FIG. 3 is a bottom exploded perspective view of the card edge connector of FIG. 1.

The two rows of terminals 20 are respectively arranged in the side walls 11 respectively. Each terminal 20 includes a retaining portion 21 fixed in the fixing groove 120, an elastic portion 22 passing through the receiving groove 121 and exposed in the card slot 101, and a soldering portion 23 extending out of the insulative housing 10. The elastic portion 22 extends upward from the retaining portion 21, and the soldering portion 23 extends downward from the retaining portion 21. The elastic portion 22 has a contact portion 220 at an upper end thereof, which protrudes into the card slot 101. The side edges of the retaining portion 21 have barbs 210 that interfere with the side wall 11, the soldering portion 23 is soldered to the mother board. The terminals 20 are assembled into the grooves 12 from a bottom of the housing. Each row of terminals 20 include a plurality of signal terminals 20S and a plurality of grounding terminals 20G. Two adjacent signal terminals 20S construe a pair of differential signal terminals, and each pair of the differential signal terminals are located with two grounding terminals 20G at each side thereof. The signal terminals 20S and the grounding terminals 20G share a substantial same construction. As shown in FIG. 1-2, the card edge connector 100 further defines an additional card slot 103 that extends independently in the longitudinal direction. The additional card slot 103 is installed with a power terminal 20P, which share a substantial same construction with the signal terminal 20S and the grounding terminal 20G.

The signal grooves 12 loaded with the signal terminal 20S are filled with the insulative blocks 30. The insulative blocks 30 are inserted in the receiving grooves 121 and fitly abut against the retaining portions 21 of the signal terminals 20S. The grounding grooves 12 loaded with the grounding terminals 20G have no insulative blocks 30 inserted, the retaining portions of the grounding terminals are exposed in the air in the receiving grooves 121. As shown clearly in FIGS. 4 and 7, understandably, the retaining portions 22 of the signal terminals 20S are surrounded by the insulative block and isolated from air due the insulative blocks 30, so as to reduce resonances producing by the signal terminals 20S, and improve a high-frequency performance of the card edge connector.

Figure 5:
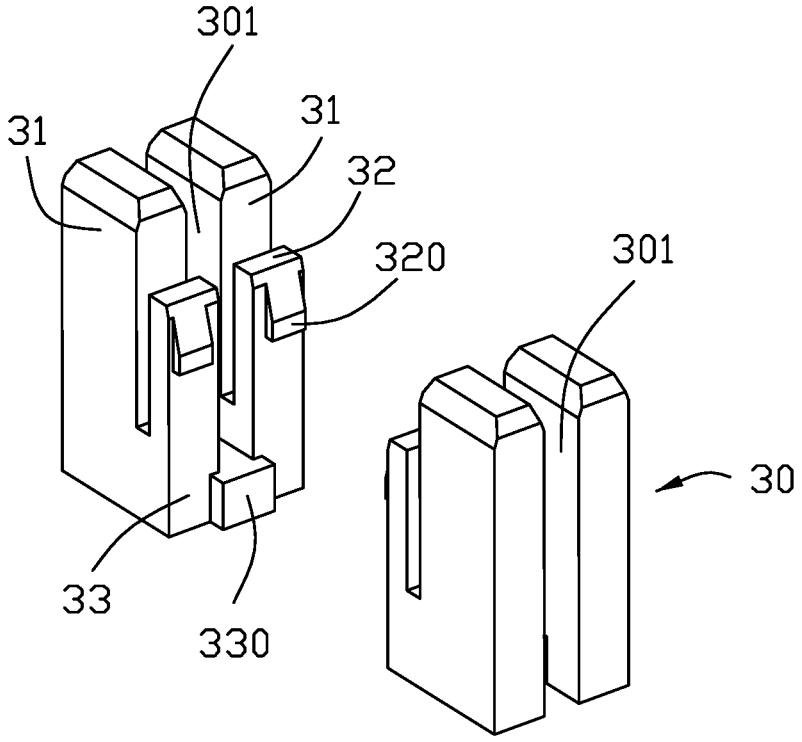
FIG. 5 is a perspective view of the insulative block of the card edge connector.
Figure 6:
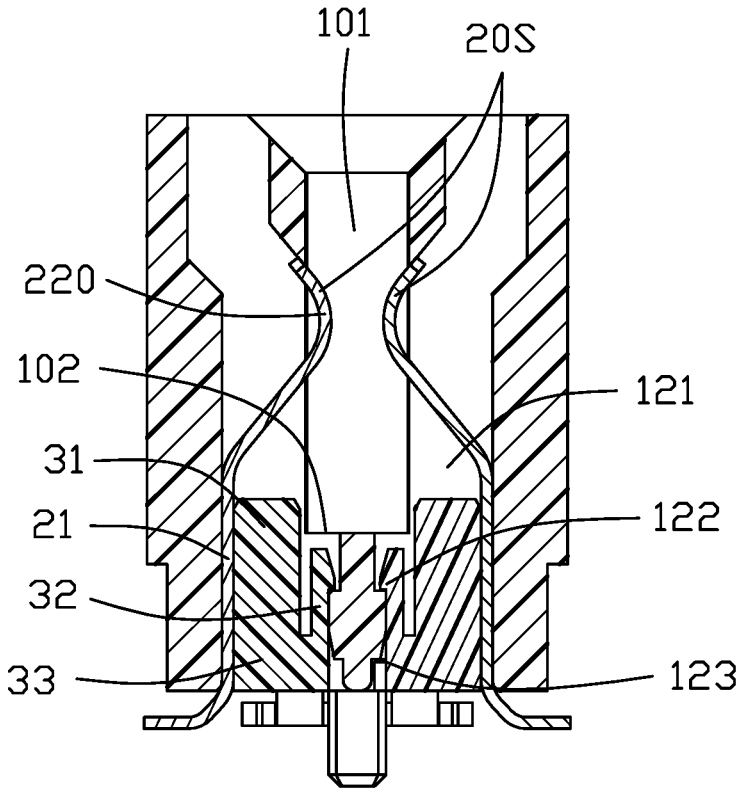
FIG. 6 is a cross-sectional view of the card edge connector of FIG. 1 taken along broken lines 6-6.
Figure 7:
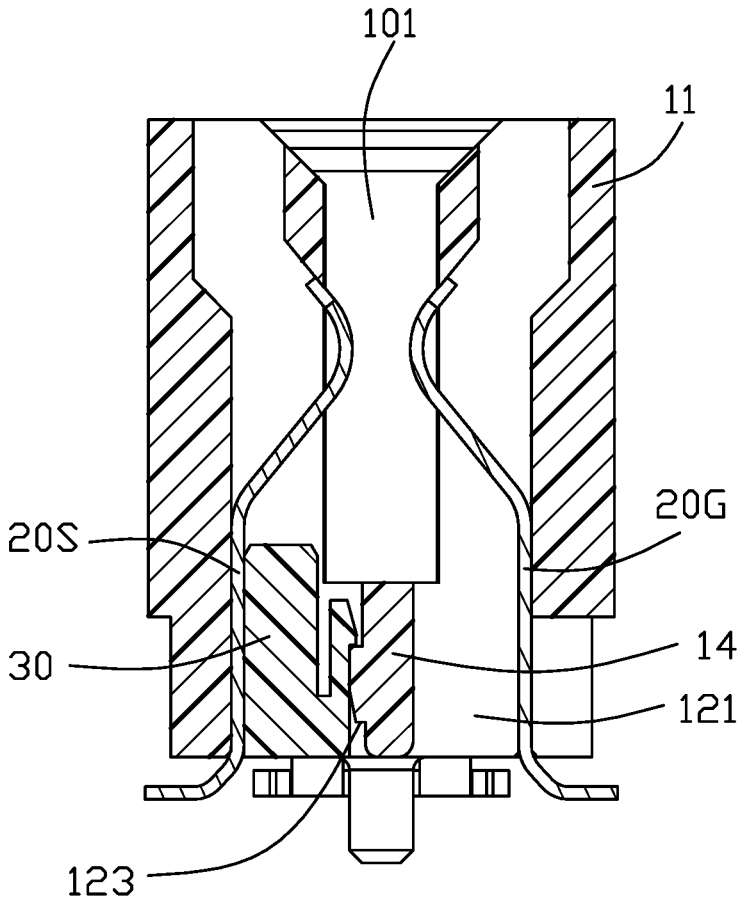
FIG. 7 is a cross-sectional view of the card edge connector of FIG. 1 taken along broken lines 7-7.
Figure 8:
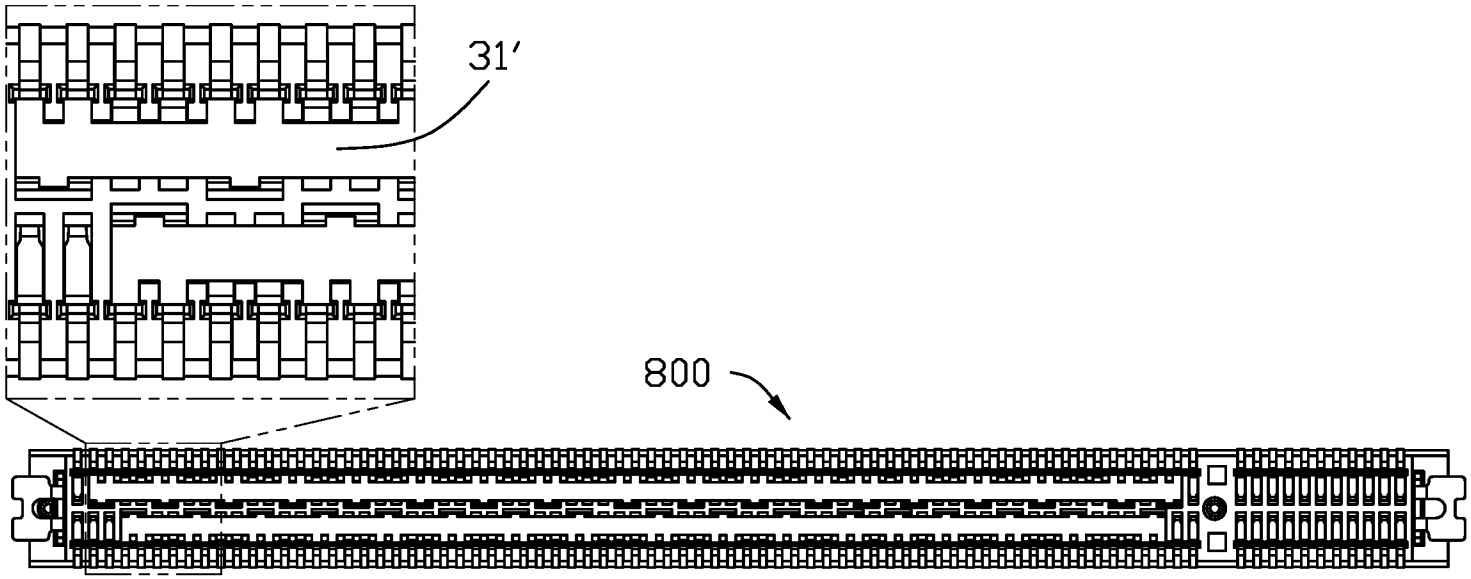
FIG. 8 is a bottom view and a partially enlarged view of a card edge connector of a second embodiment according to the invention.
Figure 9:
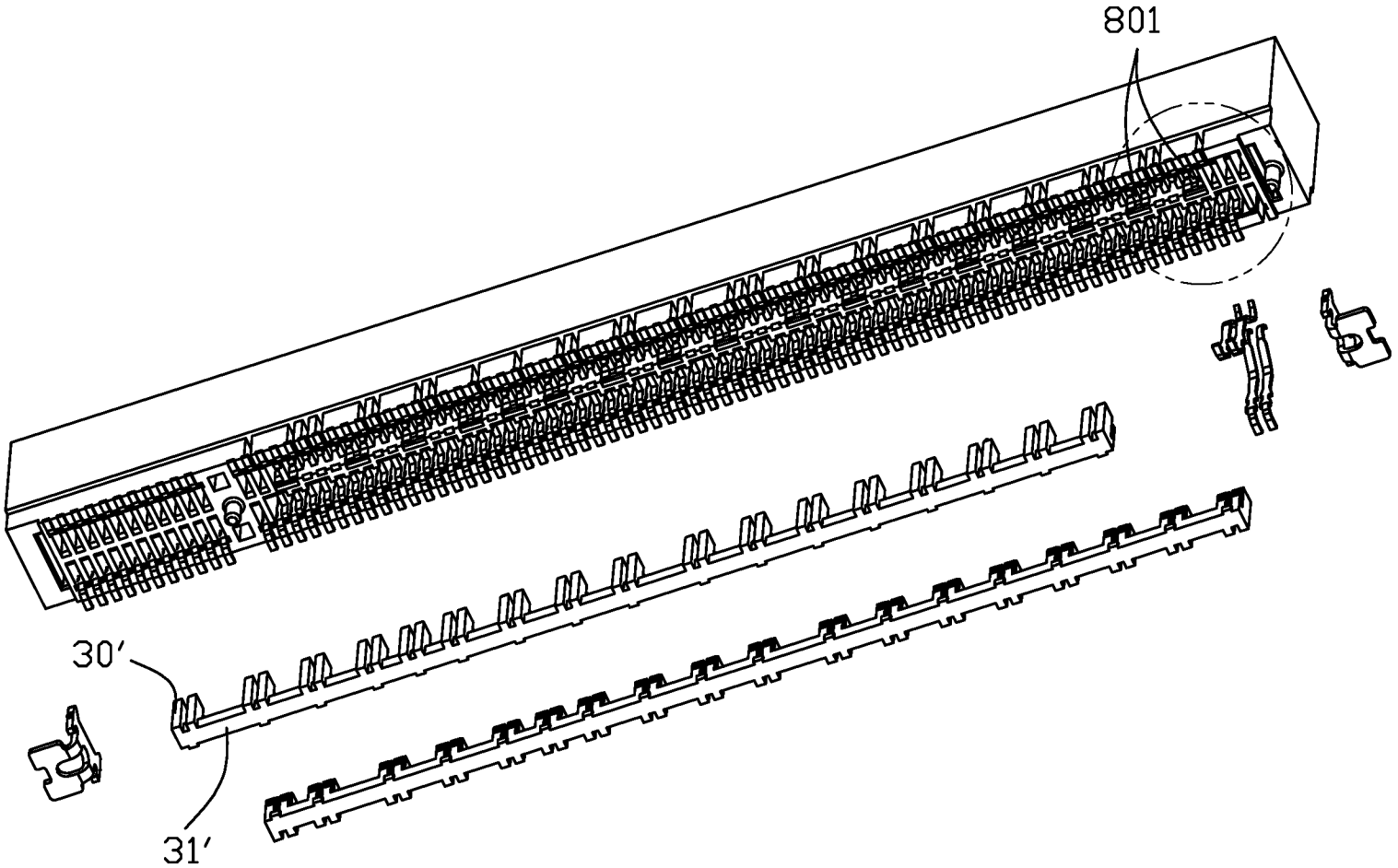
FIG. 9 is an exploded perspective view of the card edge connector of FIG. 8.
Figure 10:
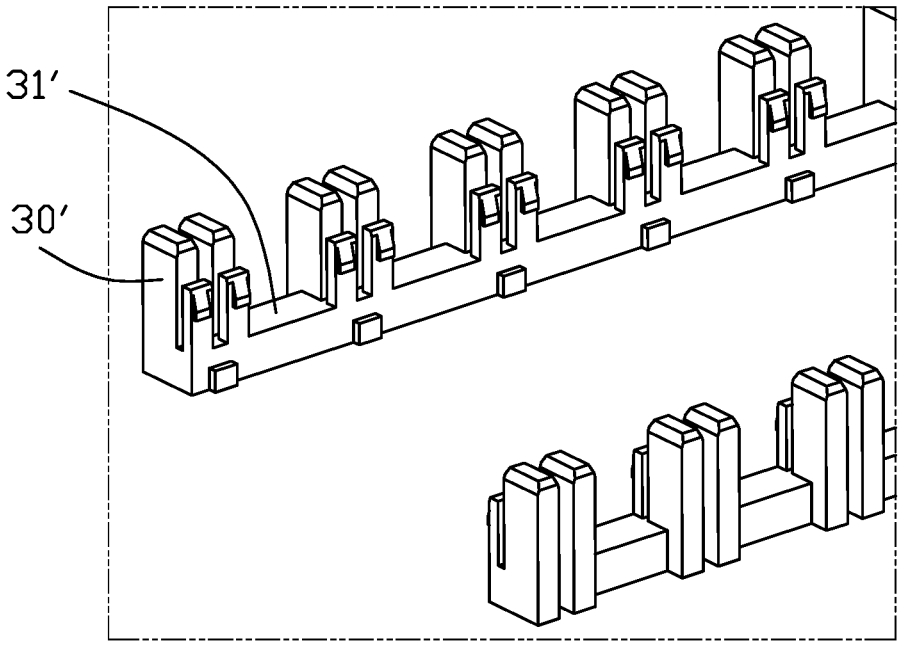
FIG. 10 is a partial enlarged exploded perspective view of the insulative block of FIG. 9.
Figure 11:
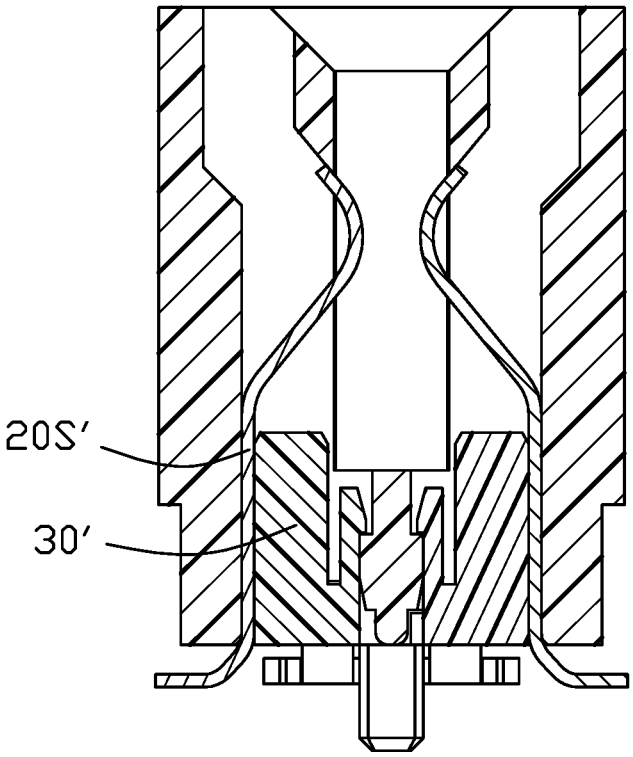
FIG. 11 is a cross-sectional view of the card edge connector.
Figure 12:
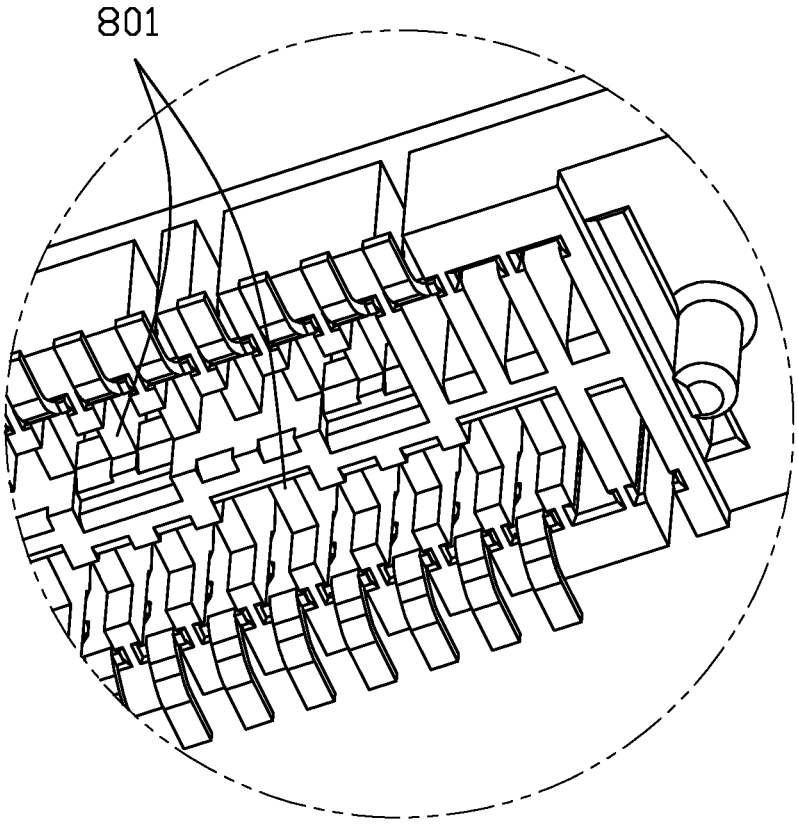
FIG. 12 is an enlarged perspective view of the card edge connector of FIG. 9 in circle.

Referring to FIGS. 5-7, the insulative block/unit 30 includes a filling portion 31 at an outside thereof along a transverse direction perpendicular to the side walls and a locking portion 32 at inside thereof, the filling portion 31 and the locking portion 32 are spaced apart from each other with a gap (not labeled) therebetween in the transverse direction, and connect with each other at a bottom by a connecting portion 33. The outer surface of the filling portion 31 presses against the signal terminals 20S, and the locking portions 32 are locked on a stepped surface or locking step 122 provided on the inner surface of the receiving groove 121 as best shown in FIGS. 6-7. The card slot 101 defines an inner bottom surface 102, a longitudinal spine 14 is under the inner bottom surface 102. The stepped surface 122 is defined on the surface of longitudinal spine 14, and the locking portion 32 locks with the stepped surface 122. The filling portion 31 extends beyond the inner bottom surface 102 in the vertical direction and does not protrude into the card slot 101 in the lateral direction. In this way, the insulative block 30 reduces resonances producing by the signal terminals 20S but does not interfere the electrical transmission among the signal terminals 20. Specifically, the locking portion 32 forms a hook end 320 at a free end thereof, and the hook end presses against on the stepped surface 122, so that the insulative block 30 can be fixed in the receiving groove and will not slip down.

Referring to FIGS. 5-7, each row of the signal terminals 20S includes pairs of differential terminals 20S, each of which includes two differential terminals adjacent to each other, each pair of differential signal terminals 20S and two grounding terminals 20G are arranged at intervals. In this embodiment, each insulative block 30 includes two filling portions 31, two locking portions 32, and a connecting portion 33 connecting therewith. The two filling portions 31 are spaced apart from each other along the longitudinal direction but connect with each together by the connecting portion 33 at the bottom. Two signal grooves 12 loaded with a pair of differential terminals 20S are assembled with the insulative block 30, and each filling portions 31 respectively presses against one differential terminal 20S in each receiving groove 121. Similarly, two locking portions 32 are spaced apart from each other but connect with each together by the connecting portion 33 at the bottom. Each of the locking portions 32 locks on the stepped surfaces 122 in the receiving groove 121.

The connecting portion 33 has a protruding portion 330 at the bottom extending to the longitudinal spine 14, the longitudinal spine 14 defines a locking step 123, the protruding portion 330 interlocks with the locking step 123 so that the insulative block 30 is positioned and prevent from moving upward when the insulative block is received in the receiving groove 121 from a bottom of the housing. A gap 301 is defined between two filling portions 31 and two locking portions 32, the gap 301 is filled with the partition wall 13 so that the insulative block are accurately positioned in the receiving groove 121. The partition wall 13 in cooperation with the gap 301 as best shown in FIG. 4 defines a notch 131 which accommodates the connecting portion 33 of the insulative block, so that the insulative block 30 does not protrude the bottom of the insulative housing 10 of the card edge connector, which facilitates the assembly and fixing of the connector.

Referring to FIGS. 8-11, illustrating a card edge connector 800 of a second embodiment of this invention, the card edge connector 800 substantially shares a same structure with the card edge connector 100 of the first embodiment, except for some features which will be mainly introduced hereinafter. The insulative blocks 30' located at a same side wall and abutting against the signal terminals 20' are integrally connected by a longitudinal strip 31' at the bottom thereof. Each insulative block 30' is same to the insulative block 30 as shown in the first embodiment. The bottom of the insulative housing defines two mounting slots 801 for accommodating the longitudinal strips, the insulating block 30' is assembled into the receiving groove 121' from the mounting slot, the bottom surface of the insulative block does not exceed the bottom surface of the insulative housing.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. A card edge connector comprising:

a longitudinal insulative housing comprising two side walls and a card slot between the side walls and opening upward, the side walls defining a plurality of grooves, and each groove opening downward and defining a fixing groove and a receiving groove;

a row of terminals arranged on the each side wall and comprising signal terminals and grounding terminals, each terminal including a retaining portion fixed in the fixing groove, an elastic portion passing through the receiving groove and exposed in the card slot, and a soldering portion extending out of the insulative housing;

a plurality of insulative blocks; wherein the receiving grooves loaded with the signal terminals are filled with the insulative blocks, and the insulative blocks fitly abut against the retaining portions of the signal terminals, the retaining portions of the grounding terminals are exposed to an air without any insulative blocks;

wherein the insulative block comprises a filling portion at an outside thereof along a transverse direction perpendicular to the side walls and a locking portion at inside thereof, the filling portion and the locking portion connect with each other at a bottom by a connecting portion, the outer surface of the filling portion presses against the signal terminals while the locking portion is locked on a stepped surface provided on an inner surface of the receiving groove;

wherein adjacent two signal terminals construe as a pair of differential terminals, the insulative block includes two filling portions, two locking portions and a connecting portion connecting therewith at the bottom thereof, the two filling portions are spaced apart from each other along the longitudinal direction but connect with each together by the connecting portion at the bottom.

2. The card edge connector as claimed in claim 1, wherein the locking portion has a hook structure locking on the stepped surface.

3. The card edge connector as claimed in claim claim 1, wherein the connecting portion has a protruding portion extending inward, the insulative housing defines a locking step, the protruding portion abuts under the locking step.

4. The card edge connector as claimed in claim 1, wherein the side wall has a partition wall between adjacent grooves, a gap defined between the two filling portions receives the corresponding partition wall.

5. The card edge connector as claimed in claim 1, wherein the insulative blocks in the same side wall are integrally connected by a longitudinal strip, the insulative housing defines a mounting slot to receive the longitudinal strip.

6. The card edge connector as claimed in claim 1, wherein the card slot defines an inner bottom surface facing upwards, and the locking portion is under the inner bottom surface.

7. The card edge connector as claimed in claim 6, wherein the filling portion extends upward beyond bottom surface in a vertical direction.

8. A card edge connector comprising:

an insulative housing comprising two long walls and a card slot between the long walls and opening upward, the long walls defining grooves, and the groove opening downward and defining a fixing groove and a receiving groove; a pair of adjacent signal terminal retained in two adjacent grooves, the signal terminal including a retaining portion fixed in the fixing groove, an elastic portion passing through the receiving groove and exposed to the card slot, and a soldering portion extending out of the insulative housing; an insulative block inserted in the receiving grooves of the two adjacent grooves; and grounding terminals; wherein the insulative blocks fitly surround the retaining portions of the pair of signal terminals to isolate from air;

wherein the grooves loaded with the grounding terminals has no insulative blocks inserted;

wherein the insulative block includes two filling portions, two locking portions and a connecting portion connecting therewith at a bottom thereof, the two filling portions are spaced apart from each other but connect with each together by the connecting portion at a bottom thereof, the filling portions are filled in the receiving grooves and the locking portions are locked with the insulating housing.

9. A card edge connector comprising:

an insulative elongated housing including a pair of side walls extending along a longitudinal direction with a card slot therebetween in a transverse direction perpendicular to the longitudinal direction;

two rows of grooves formed in the pair of side walls, respectively, each groove including a receiving groove communicating with the card slot in the transverse direction, and a fixing groove opposite to the card slot with the receiving groove therebetween;

two rows of terminals disposed in the corresponding grooves, respectively, each of said terminals including a retaining portion secured in the corresponding fixing groove, an elastic portion extending from the retaining portion and through the receiving groove and into the card slot, and a soldering portion extending from the retaining portion and out of the housing; and a plurality of insulative block units upwardly inserted into the corresponding receiving blocks from a bottom face of the housing in a vertical direction perpendicular to both the longitudinal direction and the transverse direction so as to block the corresponding receiving grooves in the vertical direction; wherein at least some of said insulative block units are equipped with corresponding resilient locking portions which engage corresponding locking steps of the housing for retention therebetween.

10. The card edge connector as claimed in claim 9, wherein the locking steps are located under and aligned with the card slot in the vertical direction.

11. The card edge connector as claimed in claim 9, wherein the insulative block units in the same row along the longitudinal direction are all unified together via a longitudinal strip along the longitudinal direction.

12. The card edge connector as claimed in claim 9, wherein each of said insulative block units includes a fitting portion spaced from the corresponding locking portion with a gap therebetween in the transverse direction.

13. The card edge connector as claimed in claim 9, wherein the insulative block units are unitarily paired corresponding to the paired neighboring grooves in the longitudinal direction.

14. The card edge connector as claimed in claim 13, wherein each of the paired insulative block units includes a connection portion linked between two corresponding fitting portions and abutting, in the vertical direction, against a corresponding partition wall which separates the neighboring grooves in the longitudinal direction.

15. The card edge connector as claimed in claim 13, wherein the paired insulative block units are associated with differential pair signal terminals of said terminals in the transverse direction.

16. The card edge connector as claimed in claim 15, wherein grounding terminals of said terminals are downwardly exposed to an exterior via the corresponding receiving grooves, respectively, in the vertical direction.

* * * * *